US005289248A

United States Patent [19]

Kurokawa

[11] Patent Number: 5,289,248

[45] Date of Patent: Feb. 22, 1994

[54] FIXING UNIT AND IMAGE FORMING APPARATUS HAVING THE SAME

[75] Inventor: Hiroto Kurokawa, Yokohama, Japan

[73] Assignee: Kabushiki Kaisha Toshiba, Kawasaki, Japan

[21] Appl. No.: 22,933

[22] Filed: Feb. 26, 1993

[30] Foreign Application Priority Data

Feb. 28, 1992 [JP] Japan ..... 4-41836

[51] Int. Cl.[5] ..... G03G 15/20

[52] U.S. Cl. ..... 355/285; 219/216; 355/290; 432/60

[58] Field of Search ..... 355/200, 203, 208, 282, 355/285, 290; 219/216, 469; 432/60

[56] References Cited

U.S. PATENT DOCUMENTS

| | | | |
|---|---|---|---|
| 3,998,584 | 12/1976 | Wada et al. | 432/60 |
| 4,163,893 | 8/1979 | Turini | 219/216 |
| 4,598,990 | 7/1986 | Kusumoto et al. | 219/216 X |
| 5,017,970 | 5/1991 | Sakata | 355/290 |
| 5,111,250 | 5/1992 | Kashiwagi | 355/285 |

FOREIGN PATENT DOCUMENTS

| | | | |
|---|---|---|---|
| 3842745 | 7/1989 | Fed. Rep. of Germany | 355/285 |
| 58-46418 | 10/1983 | Japan . | |
| 0055370 | 3/1985 | Japan | 355/285 |

*Primary Examiner*—A. T. Grimley
*Assistant Examiner*—William J. Royer
*Attorney, Agent, or Firm*—Foley & Lardner

[57] ABSTRACT

A fixing unit includes a photosensitive drum for bearing an image, an image forming member for forming the image on the photosensitive drum, a transfer charger for transferring the image formed by the image forming member to paper, a heating roller having a heat source for generating heat when a power supply is turned on for heating the paper to which the image is transferred by the transfer charger, a rotatable pressing roller which is brought into contact with and separated from the heating roller, for pressing the paper against the heating roller, a rotating plate for separating the pressing roller from the heating roller when the power supply is turned on, and a driving mechanism for rotating the pressing roller separated from the heating roller by the rotating plate. The driving mechanism includes a first gear arranged in the heating roller, a second gear arranged in the pressing roller, a driving gear engaged with the first gear and engaged with the second gear by a driven gear, and a driving motor for rotating the driving gear.

10 Claims, 8 Drawing Sheets

FIXING UNIT AND IMAGE FORMING APPARATUS HAVING THE SAME

BACKGROUND OF THE INVENTION

1. Field of the Invention

The present invention relates to a fixing unit for fixing a transfer image on paper, which is included in, for example, an electronic copying machine, and to an image forming apparatus having the fixing unit.

2. Description of the Related Art

An electronic copying machine includes a photosensitive body, and a latent image is formed on the photosensitive body by an image forming means. The latent image is supplied with a developer and thus developed. The developed image is transferred to paper by the operation of a transfer charger, and the paper is fed to a fixing unit, thereby fixing the image on the paper. The fixing unit includes a fixing roller and a pressing roller pressed on the fixing roller. The paper is caused to pass between the fixing and pressing rollers, and heated and pressed accordingly. The pressing roller is attached to a housing of the fixing unit, which is freely opened and closed, and contacts/separates from the fixing roller by opening/closing the housing. Normally, the pressing roller remains pressed against the fixing roller, irrespective of ON and OFF states of a power supply.

If an electronic copying machine is left alone for a long time and then its power is turned on, irregularity in temperature may occur in the fixing unit even in the ready state. Particularly in an electronic copying machine in which paper is heated only by a heater of a fixing roller, it goes into the ready state even when a portion opposite to a portion of a pressing roller pressed against the fixing roller remains cold. If, therefore, paper is caused to pass between the fixing and pressing rollers, a difference in temperature between both sides of the paper is considerably widened, and the paper is greatly curled. Even though the paper is not greatly curled, a low-temperature portion of the paper absorbs heat and a defect in fixing occurs accordingly.

In order to prevent the paper from being curled or to prevent the defect in fixing, a conventional copying machine has a technique of rotating the fixing and pressing rollers to uniform the surface temperature of the pressing roller when the copying machine is warmed up.

However, the warm-up time of an electronic copying machine is considered to be as important as the quality of an image, in view of its usage. If the pressing roller is rotated, it takes 50% longer time to warm up the machine than when the pressing roller is not rotated. Needless to say, this is because the pressing roller always contacts the fixing roller and the fixing roller absorbs heat as the pressing roller rotates.

A pressing roller of low hardness has recently been used to increase the rate of fixing. If, however, such a pressing roller is pressed against a fixing roller, a great creep occurs, resulting in a blur of fixing. Further, in a preheat mode, for keeping the temperature of the fixing roller lower than the usual temperature for fixing since the pressing roller remains pressed against the fixing roller, the pressing roller cannot be heated uniformly in the former case.

SUMMARY OF THE INVENTION

It is accordingly an object of the present invention to provide a fixing unit capable of making no difference in temperature between a heating means and a pressing means for a short warm-up time to prevent the curl of paper and the defect in fixing, uniformly heating the pressing means in a preheat mode, and without causing any blur of transfer due to creep.

According to a first aspect of the present invention, there is provided a fixing apparatus for fixing an image onto an image bearing member, comprising: means for heating an image bearing member having an image thereon; means, which is movable between a first position brought into contact with the heating means and a second position separated from the heating means, for pressing the image bearing member against the heating means at the first position; means for moving the pressing means from the first position to the second position; a first gear arranged in the heating means; a second gear arranged in the pressing means and movable in accordance with the movement of the pressing means; a third gear meshed with the second gear when the pressing means is at the second position; a fourth gear meshed with the first gear and the third gear; and means for rotating the fourth gear.

According to a second aspect of the present invention, there is provided a fixing apparatus for fixing an image onto an image bearing member comprising: means for heating an image bearing member, having an image thereon, at a predetermined temperature; means for selecting a mode between a usual mode and a preheat mode; means for keeping the heating means at a first temperature in the usual mode, and for keeping the heating means at a second temperature which, is lower than the first temperature, in the preheat mode; means, which is movable between a first position brought into contact with the heating means and a second position separated from the heating means, for pressing the image bearing member against the heating means at the first position; means for moving the pressing means between the first position and the second position; means for controlling the moving means to move the pressing means from the first position to the second position when the preheat mode is selected by the selecting means, and to move the pressing means from the second position to the first position when the usual mode is selected by the selecting means; and means for rotating the pressing means when the pressing means is located at the second position.

According to a third aspect of the present invention, there is provided an image forming apparatus comprising: means for forming an electrostatic image on an image bearing body; means for developing the image by supplying a developing member to the electrostatic image; means for transferring the developed image from the image bearing body to a sheet; means for heating the sheet, having the image transferred by the transferring means thereon, at a predetermined temperature; means for selecting a mode between a usual mode and a preheat mode; means for keeping the heating means at a first temperature in the usual mode, and for keeping the heating means at a second temperature which, is lower than the first temperature, in the preheat mode; means, which is movable between a first position brought into contact with the heating means and a second position separated from the heating means, for pressing the image bearing member against the heating means at the first position; means for moving the pressing means between the first position and the second position; means for controlling the moving means to move the pressing means from the first position to the second position when the preheat mode is selected by the selecting means, and to move the pressing means from the second position to the first position when the usual mode is selected by the selecting means; and means for rotating the pressing means when the pressing means is located at the second position.

Additional objects and advantages of the invention will be set fourth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 5 is a flowchart showing an operation of the fixing unit shown in FIG. 2 when a power supply is turned on;

DETAILED DESCRIPTION OF THE PREFERRED EMBODIMENTS

An embodiment of the present invention will now be described, with reference to FIGS. 1 to 8.

Figure 1:
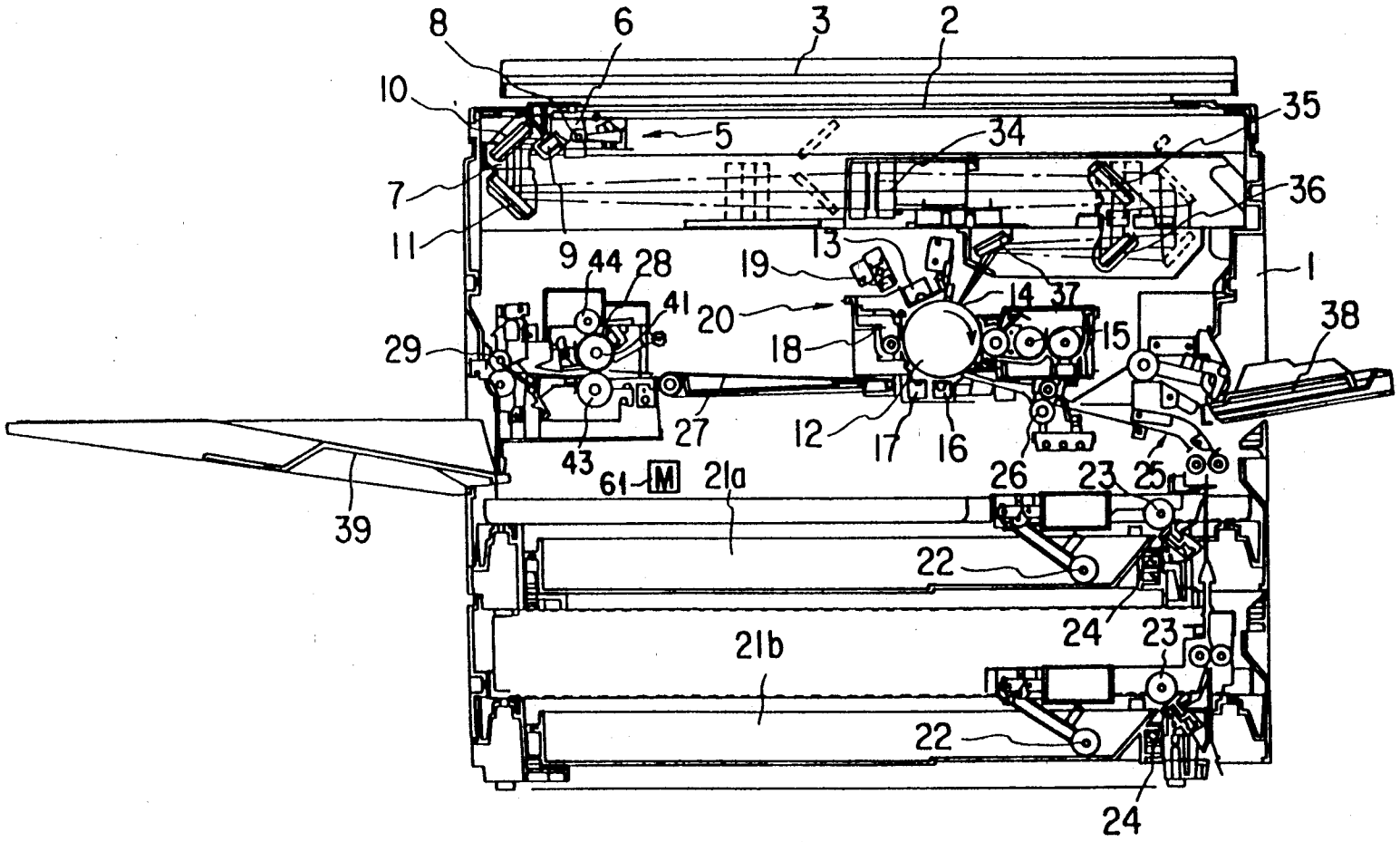
FIG. 1 is a schematic view showing a constitution of an image forming apparatus according to an embodiment of the present invention.

FIG. 1 is a schematic view showing a constitution of an electrophotographic copying machine. In FIG. 1, reference numeral 1 indicates a body of the copying machine. A document table glass 2 is formed on the upper surface of the body 1, and a document pressing device 3 for pressing a document on the document table glass 2 is formed on the glass 2.

An optical system 5 is provided in the upper portion of the body 1 and includes first and second carriages 6 and 7 running along the document table glass 2. The first carriage 6 includes an exposure lamp 8 and a first mirror 9, and the second carriage 7 includes second and third mirrors 10 and 11.

A lens 34 is arranged in an optical path of light reflected by the third mirror 11, and the light passing through the lens 34 forms an image on a photosensitive drum 12 via fourth to sixth mirrors 35, 36 and 37.

A charger 13 and an exposure unit 14 are arranged above the photosensitive drum 12. A development unit 15 is provided on one side of the drum 12. A transfer charger 16 and a separation charger 17 are arranged below the drum 12. A cleaning unit 18 and an elimination charger 19 are arranged on the other side of the drum 12.

The photosensitive drum 12, charger 13, exposure unit 14, development unit 15, transfer charger 16, separation charger 17, cleaning unit 18, and elimination charger 19 constitute an image forming means 20.

Paper feeding cassettes 21*a* and 21*b* are detachably mounted in the lower portion of the body 1, and paper sheets in the paper feeding cassettes 21*a* and 21*b* are picked up by a pick-up roller 22. These sheets are separated from each other and sent out one by one by a paper feeding roller 23 and a separation plate 24 contacting the roller 23, and carried along a carrying path 25.

An aligning roller 26, transfer charger 16, separation charger 17, carrying belt 27, fixing unit 28, and paper discharge roller pair 29, are arranged on the carrying path 25 in the carrying direction of the sheets.

A manual paper feeding tray 38 is provided on one side of the body 1, and a paper discharging tray 39 is provided on the other side thereof.

To form an image, a document is set on the document table glass 2 and pressed thereon by the document pressing device 3. This document is irradiated with light from the exposure lamp 8. Light reflected by the document is sent to the lens 34 via the first to third mirrors 9 to 11. The reflected light passes through the lens 34 and then transmitted to the photosensitive drum 12 via the fourth to sixth mirrors 35 to 37, thereby forming an electrostatic latent image thereon. This electrostatic latent image is sent to the development unit 15 by rotation of the photosensitive drum 12 and supplied with a developer, with the result that the latent image is made visible. The visible image is transferred to paper supplied from the paper feeding cassettes 21*a* and 21*b*. This paper is separated from the photosensitive drum 12 by the operation of the separation charger 17 and then carried by the running of the carrying belt 27. Further, the paper is sent to the fixing unit 28, by which the transferred image is fixed on the paper. The paper on which the image is fixed, is discharged onto the paper discharge tray 39 by means of the roller pair 29.

Figure 2:
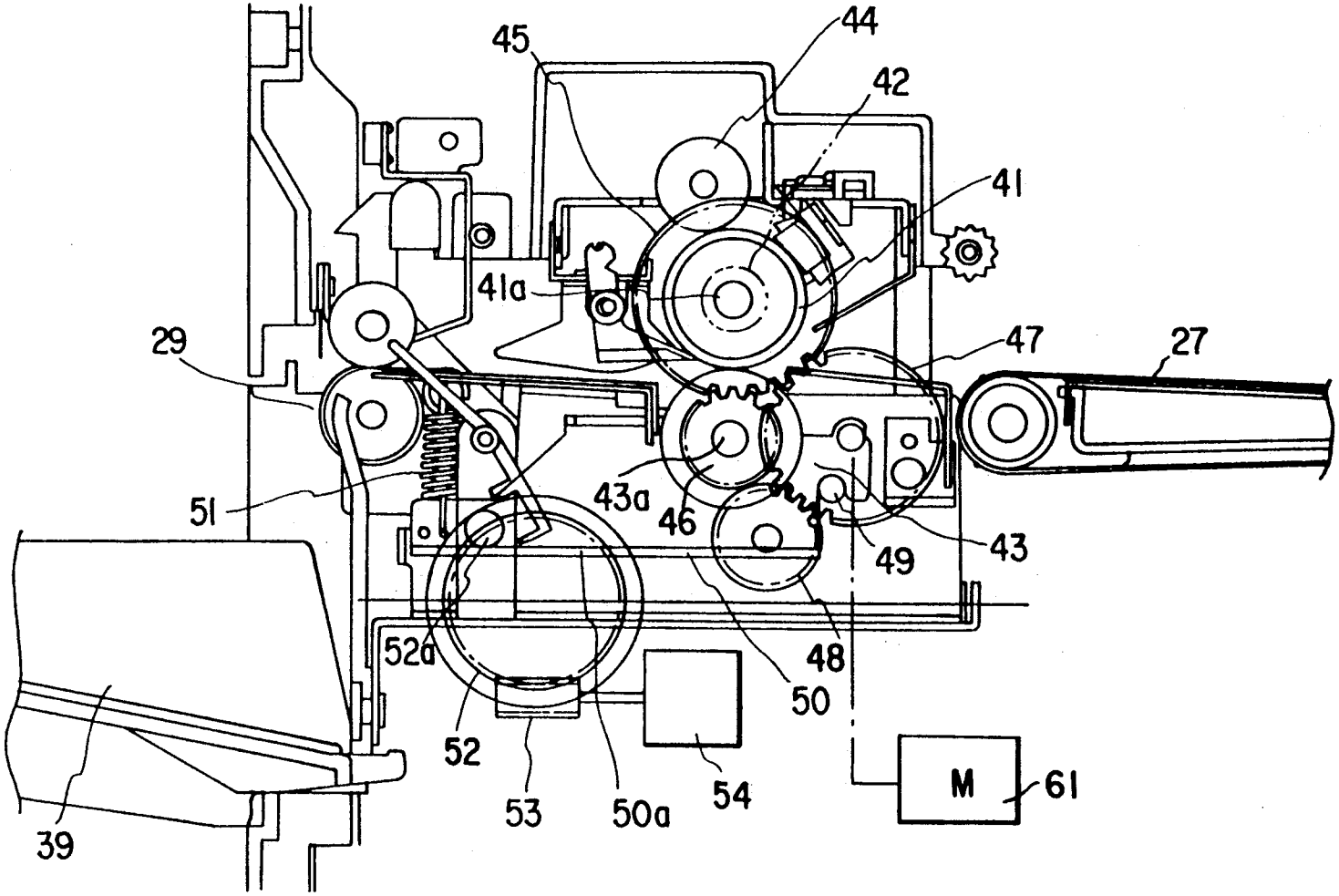
FIG. 2 is a schematic view showing a constitution of a fixing unit includes in the image forming apparatus shown in FIG. 1.

FIG. 2 shows a constitution of the fixing unit 28. In FIG. 2, reference numeral 41 denotes a rotatable fixing roller serving as a heating means. A heater 42 is arranged in the fixing roller 41, and a rotatable pressing roller 43 serving as a pressing means is pressed against the lower portion of the fixing roller 41. Further, a cleaning roller 44 is pressed against the upper portion of the fixing roller 41.

A fixing roller gear 45 serving as a first gear for constituting a drive means is integrally formed with one end of a rotation axis 41*a* of the fixing roller 41, and a pressing roller gear 46 serving as a second gear is integrally formed with one end of a rotation axis 43*a* of the pressing roller 43. A drive input gear 47 serving as a fourth gear is engaged with the fixing roller gear 45 and also engaged with the pressing roller gear 46 by means of a drive idler 48 serving as a third gear. In other words, the drive input gear 47 is used as an input gear for both the fixing and pressing roller gears 45 and 46. A main motor 61 serving as a drive motor is connected to the drive input gear 47.

Figure 4:
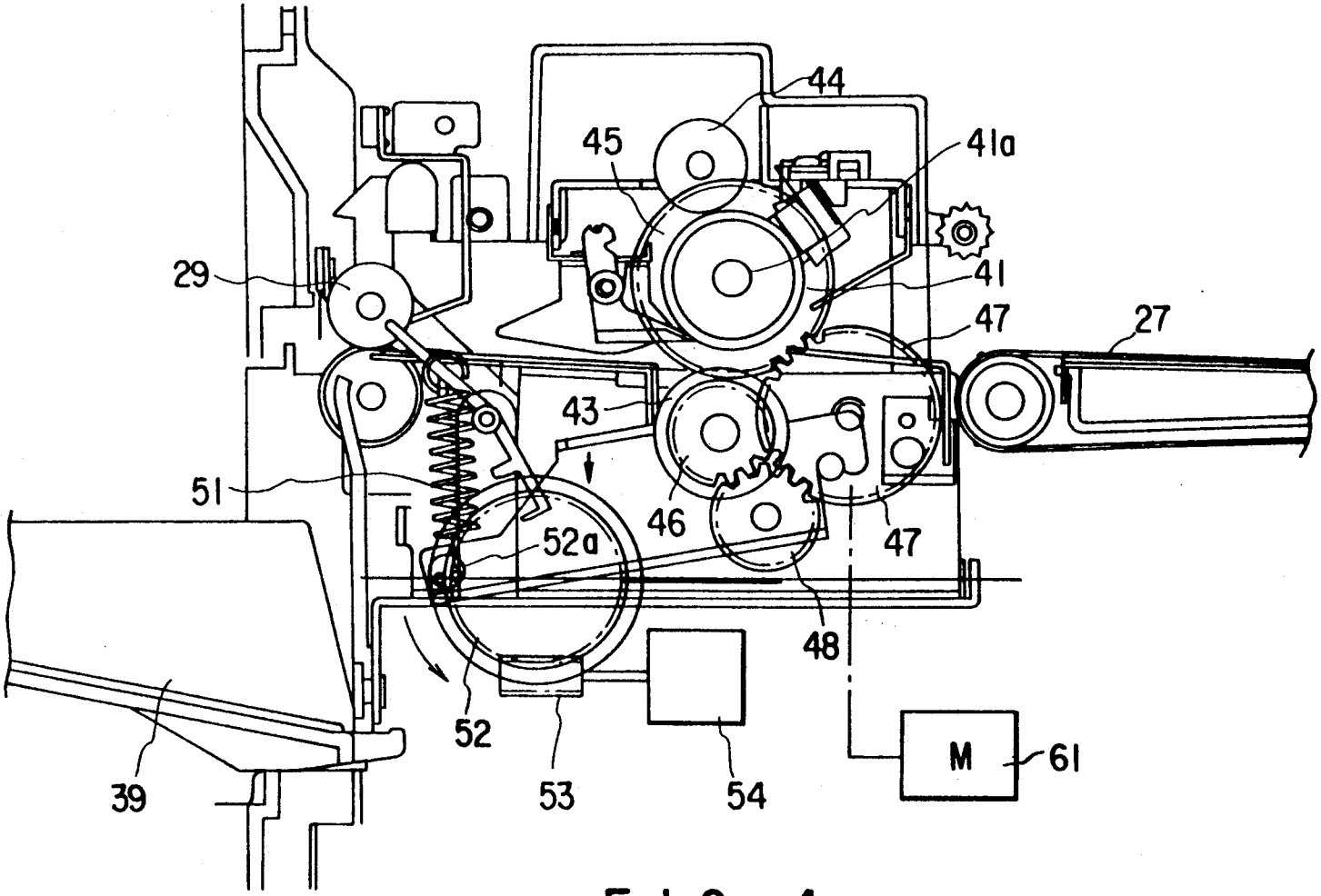
FIG. 4 is a view of the pressing and fixing rollers of the fixing unit shown in FIG. 2, the former being separated from the latter.

The pressing roller 4 is attached to an intermediate portion of a rotating plate 50 one end of which is rotatably supported by a spindle 49. The other end of the rotating plate 50 is energized upward by a coil spring 51, and the pressing roller 43 is pressed against the fixing roller 41 by the energization. When the pressing roller 43 contacts with the fixing roller 41, the pressing roller 43 is located at a first position. Furthermore, a curved portion 50*a* is formed at a lower end portion of the rotating plate 50, and a cam 52*a* of a gear 52 is attached to the curved portion. A worm gear 53 is engaged with the gear 52 and rotated by a drive motor 54. When a power supply is turned off, the rotating plate 50 is rotated downward and as shown in FIG. 4, the pressing roller 43 is located at a second position separated from the fixing roller 41. When the pressing roller 43 is located at the second position the pressing gear 46 is engaged with the drive idler 48

Figure 5:
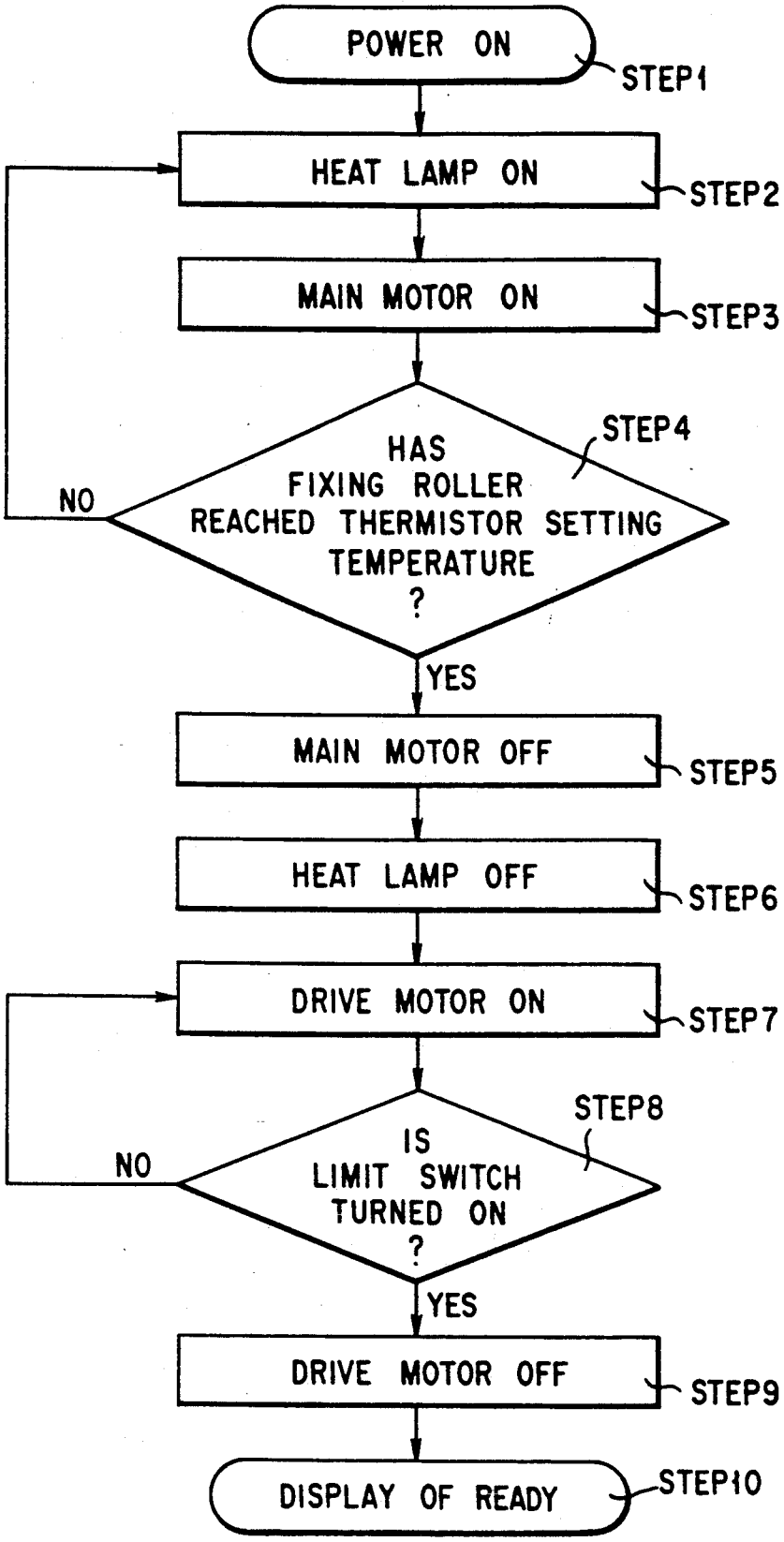

As shown in FIG. 5, when the power supply is turned on (Step 1), a heat lamp 42 of the fixing roller 41 is turned on (Step 2), and the main motor 61 is also turned on (Step 3). If the main motor 61 is turned on, the drive input gear 47 is rotated the fixing roller 41 is rotated by means of the fixing roller gear 45, and the pressing roller 43 is rotated by means of the drive idler 48 and the pressing roller gear 46. As shown in FIG. 4, the fixing roller 41 and the pressing roller 43 are rotated while separated from each other, and the surface of the pressing roller 43 is heated by heat generated from the fixing roller 41. When the fixing roller 41 reaches a thermistor setting temperature (Step 4), the main motor 61 is turned off (Step 5) and then the heat lamp 42 is turned off (Step 6).

Figure 3:
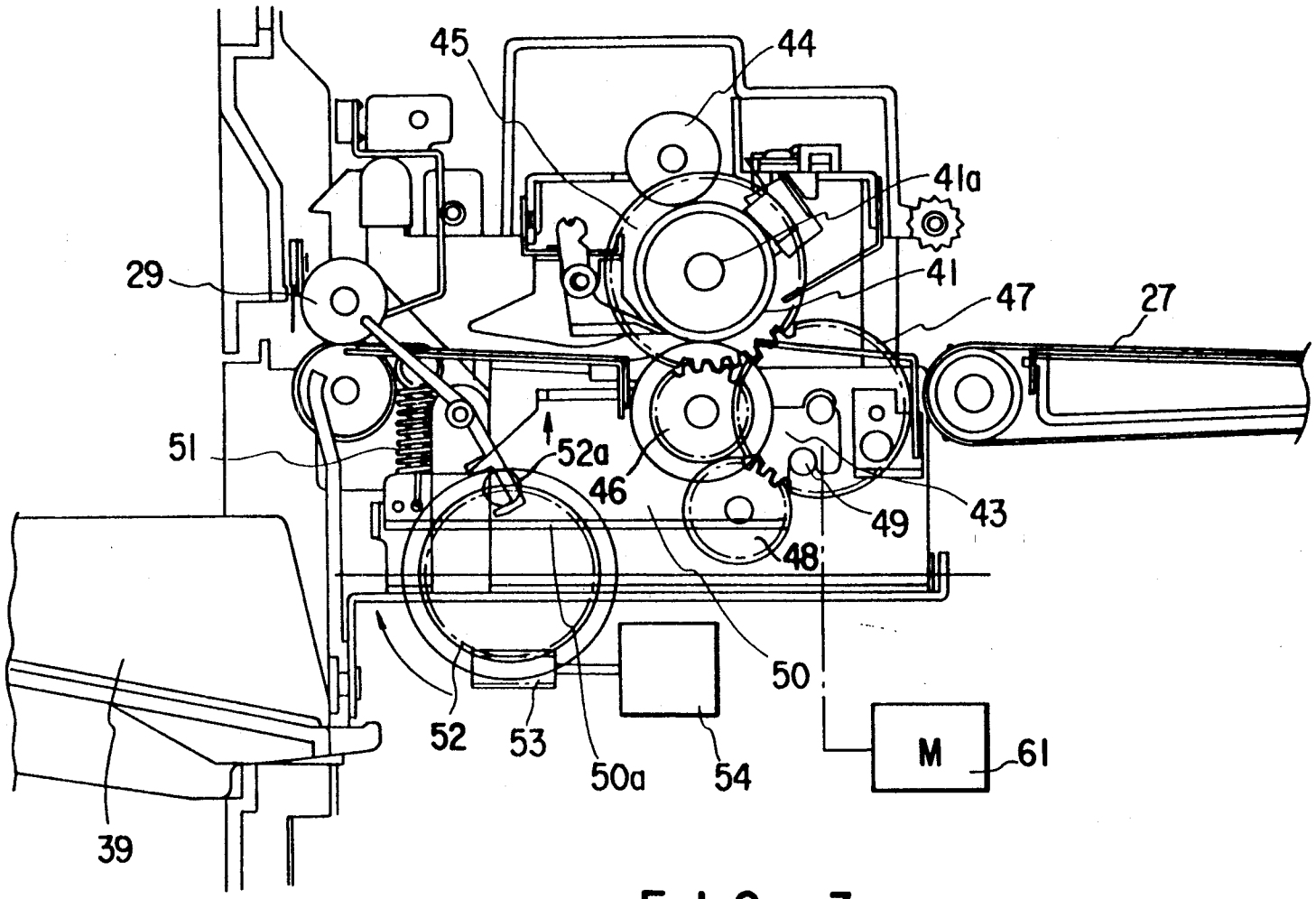
FIG. 3 is a view of a pressing roller and a fixing roller of the fixing unit shown in FIG. 2, the former being pressed against the latter.

After that, the drive motor 54 of the rotating plate 50 is started (Step 7), and the gear 52 is rotated by means of the worm gear 53 in the direction of the arrow shown in FIG. 3. The rotating plate 50 is thus rotated upward by the energization of the coil spring 51, and the pressing roller 43 is pressed against the fixing roller 41. The pressing roller 43 is moved from the second position to the first position, and the engagement between the pressing roller gear 46 and the drive idler 48 is released. The pressing roller 43 is then brought into contact with the fixing roller 41 and rotated in accordance with the rotation of the fixing roller 41. If this pressing is detected by a limit switch (Step 8), the drive motor 54 is stopped (Step 9), and "READY" is displayed (Step 10).

Figure 6:
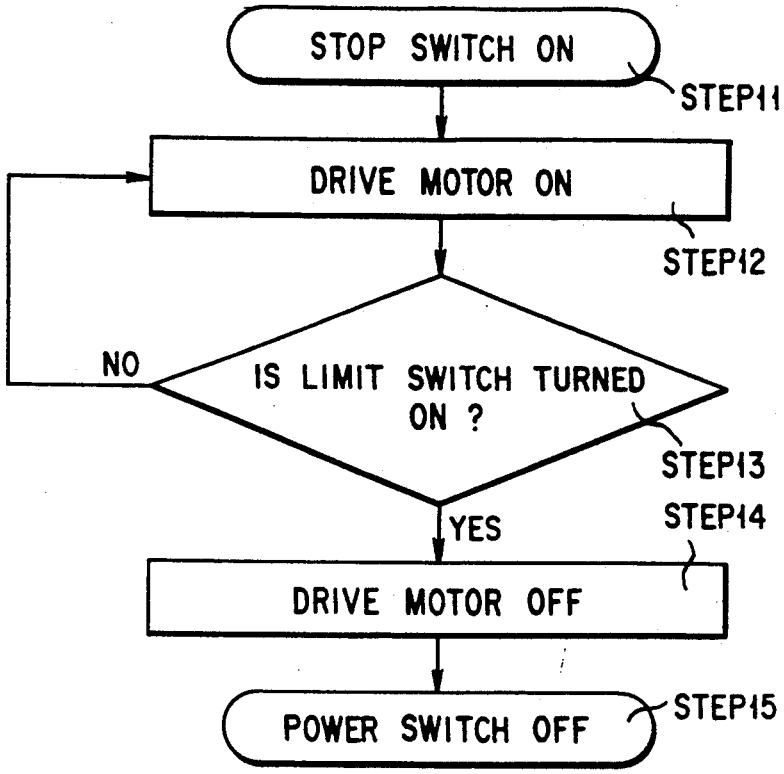
FIG. 6 is a flowchart showing an operation of the fixing unit shown in FIG. 2 when the power supply is turned off.

The power supply is turned off as indicated by the flowchart shown in FIG. 6. More specifically, a stop switch is turned on (Step 11), and the drive motor 54 of the rotating plate 50 is started (Step 12). Thus, the gear 52 is rotated by the worm gear 53 in the direction of the arrow shown in FIG. 4, the rotating plate 50 is rotated downward against the energization of the spring 51 by the cam 52*a*, and the pressing roller 43 descends and separates from the fixing roller 41. The pressing roller 43 is moved from the first position to the second position. The pressing roller gear 46 and the drive idler 48 are then engaged with each other again, and the pressing roller 43 is rotated while being spaced away from the fixing roller 41. If the limit switch is turned on by the descent of the pressing roller 43 (Step 13), the drive motor 54 is turned off (Step 14) and the power switch is turned off (Step 15).

As described above, when the pressing roller 43 is located at the first position where it contacts the fixing roller 41, it is rotated in accordance with the rotation of the fixing roller 41 and, when the pressing roller 43 is located at the second position where it is spaced away from the fixing roller 41, it is rotated by the drive input gear 47.

Figure 7:
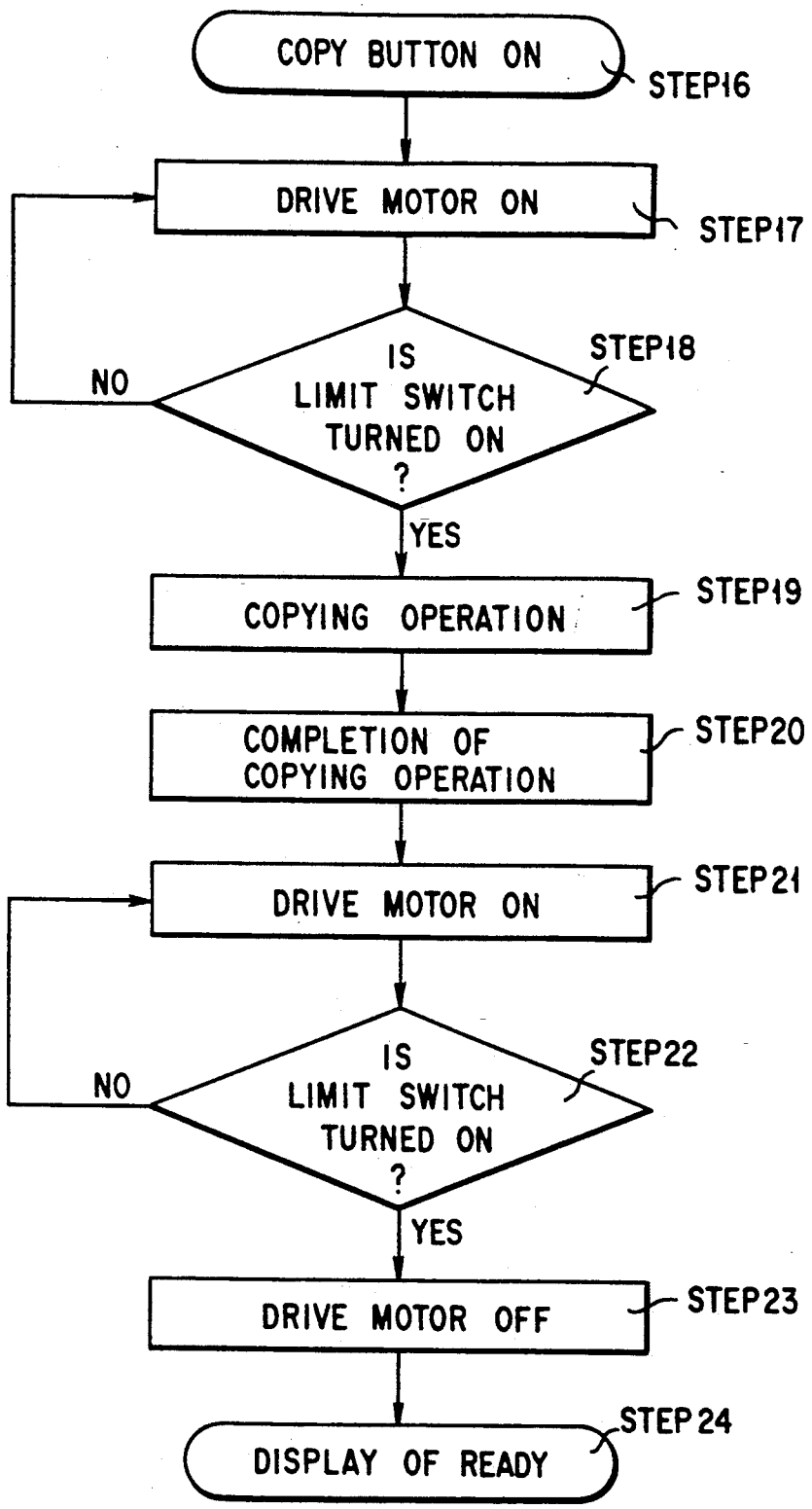
FIG. 7 is a flowchart showing a copying operation of the image forming apparatus shown in FIG. 1.

An image is formed in accordance with the flowchart shown in FIG. 7. More specifically, a copy button is turned on (Step 16) to start the drive motor 54 (Step 17), and the gear 52 is rotated by the worm gear 53 in the direction of the arrow shown in FIG. 3. Thus, the rotating plate 50 is rotated upward by the energization of the spring 51, and the pressing roller 43 is pressed against the fixing roller 41. If this pressing is detected by the limit switch (Step 18), a copying operation is started (Step 19) and an image is formed on paper. This paper is carried, and heated and pressed between the fixing roller 41 and the pressing roller 43, thereby fixing the image on the paper.

Completing the copying operation (Step 20), the drive motor 54 is operated (Step 21) and, as shown in FIG. 4, the rotating plate 50 is rotated downward against the energization of the spring 51, and the pressing roller is separated from the fixing roller 41. If the limit switch is turned on (Step 22) by the separation, the drive motor 54 is stopped (Step 23), and "READY" is displayed (Step 24).

When the copying machine is not used for a period such as a lunch time, the copying machine is able to be set in a preheat mode, in a preheat mode, the temperature of the fixing roller 41 serving as a second temperature is kept lower than the temperature at which the fixing roller 41 is able to fix an image onto a paper. In a usual copying mode, the fixing roller 41 is heated at a first temperature, and in a preheat mode the fixing roller 41 is heated at a second temperature which is lower than the first temperature. Thus, the copying machine is able to save energy while the copying machine is not used.

Figure 8:
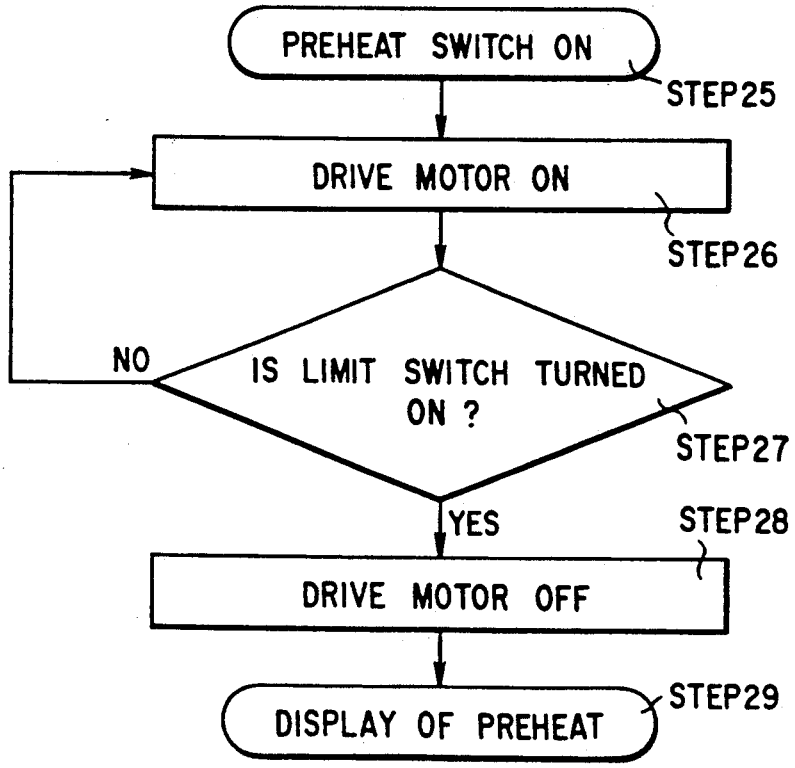
FIG. 8 is a flowchart showing an operation of the fixing unit shown in FIG. 2 in a preheat mode.

The setting of a preheat mode after the copying operation is executed in accordance with the flowchart shown in FIG. 8. More specifically, a preheat switch is turned on (Step 25) to turn on the drive motor 54 of the rotating plate 60 (Step 26). Thus, the gear 52 is rotated by the worm gear 53 in the direction of the arrow shown in FIG. 4, the rotating plate 50 is rotated downward against the energization of the spring 51 by the cam 52*a*, and the pressing roller 43 descends and separates from the fixing roller 41. If the limit switch is turned on by the descent of the pressing roller 43 (Step 27), the drive motor 54 is stopped (Step 28) and "PREHEAT" is displayed (Step 29).

Since, as described above, the pressing roller is rotated while separated from the fixing roller 41 when the power supply is turned on, the pressing roller 43 does not directly absorb the heat of the fixing roller 41, and the warm-up time can remarkably be shortened. When the power supply is turned off, the pressing roller 43 is separated from the fixing roller 41. Therefore, no creep occurs in the pressing roller 43 even though the apparatus is left alone for a long time. Furthermore, since the pressing roller 43 is rotated while being separated from the fixing roller 41 in the preheat mode, the pressing roller can be uniformly heated.

In the above embodiment, the pressing roller 43 is brought into contact with and separated from the fixing roller 41 using the drive motor 54 and the cam 52. However, the present invention is not limited to this, but the relationship between the fixing roller 41 and the pressing roller 43 can be formed as shown in FIG. 9.

Figure 9:
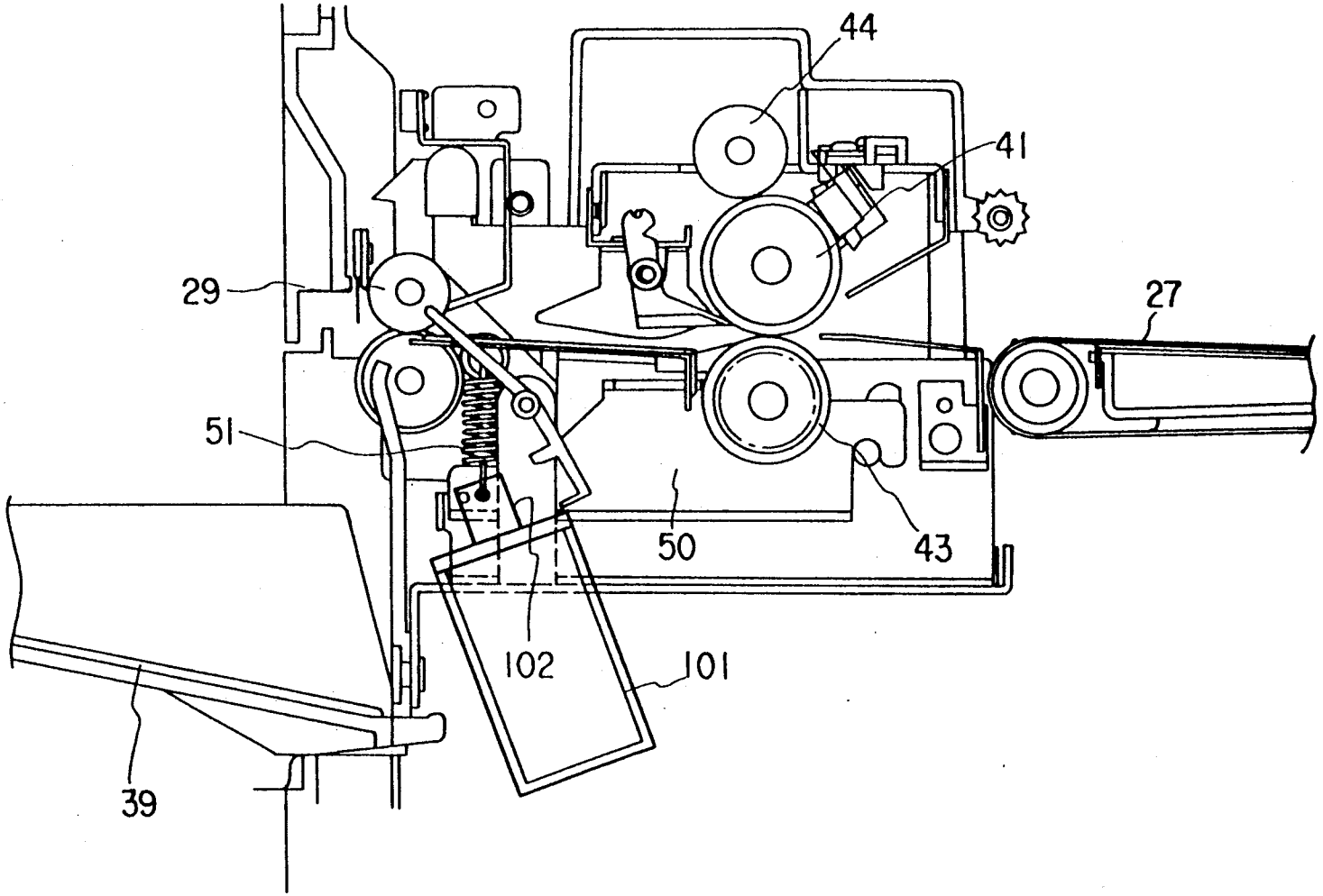
FIG. 9 is a view showing a constitution of a fixing unit according to another embodiment of the present invention.

In FIG. 9, reference numeral 101 indicates a solenoid. An operator 102 of the solenoid 101 is connected to a end of the rotating plate 50. When the solenoid 101 is turned on/off, the operator 102 advances/retreats, and the rotating plate 50 is rotated, with the result that the pressing roller 43 is brought into contact with-/separated from the fixing roller 41.

As described above, according to the present invention, the pressing roller 43 is rotated while being separated from the fixing roller 41 at the warm-up time. Therefore, unlike the conventional apparatus, the pressing roller 43 does not directly absorb the heat of the fixing roller 41, and the warm-up time can be remarkably shortened to make no difference in temperature between the pressing roller 43 and the fixing roller 41, thereby preventing curl of paper and a defect in fixing.

Since the pressing roller 43 is separated from the fixing roller 41 when the power supply is turned off, no creep occurs in the pressing roller 43 even though the apparatus is left alone for a long time, or a blur of fixing can be prevented.

Furthermore, since the pressing roller 43 is rotated while being separated from the fixing roller 41 in the preheat mode, the pressing roller 43 can be uniformly heated.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fixing apparatus for fixing an image onto an image bearing member, comprising:

means for heating an image bearing member having an image thereon;

means, which is movable between a first position brought into contact with the heating means and a second position separated from the heating means, for pressing the image bearing member against the heating means at the first position;

means for moving the pressing means from the first position to the second position;

a first gear arranged in the heating means;

a second gear arranged in the pressing means and movable in accordance with the movement of the pressing means;

a third gear meshed with the second gear when the pressing means is at the second position;

a fourth gear meshed with the first gear and the third gear; and means for rotating the fourth gear.

2. A fixing apparatus according to claim 1, wherein the second gear is engaged with the third gear when the pressing means is located at the second position, and the second gear is separated from the third gear when the pressing means is located at the first position.

3. A fixing apparatus for fixing an image onto an image bearing member comprising:

means for heating an image bearing member, having an image thereon, at a predetermined temperature;

means for selecting a mode between a usual mode and a preheat mode;

means for keeping the heating means at a first temperature in the usual mode, and for keeping the heating means at a second temperature which, is lower than the first temperature, in the preheat mode;

means, which is movable between a first position brought into contact with the heating means and a second position separated from the heating means, for pressing the image bearing member against the heating means at the first position;

means for moving the pressing means between the first position and the second position;

means for controlling the moving means to move the pressing means from the first position to the second position when the preheat mode is selected by the selecting means, and to move the pressing means from the second position to the first position when the usual mode is selected by the selecting means; and means for rotating the pressing means when the pressing means is located at the second position.

4. A fixing apparatus according to claim 3, wherein the rotating means includes a first gear arranged in the heating means, a second gear arranged in the pressing means, a third gear meshed with the second gear when the pressing means is at the second position, a fourth gear meshed with the first gear and the third gear, and a motor for rotating the fourth gear.

5. A fixing apparatus according to claim 4, wherein the second gear is movable in accordance with the movement of the pressing means.

6. A fixing apparatus according to claim 3, wherein the second gear is engaged with the third gear when the pressing means is located at the second position, and the second gear is separated from the third gear when the pressing means is located at the first position.

7. An image forming apparatus comprising:

means for forming an electrostatic image on an image bearing body;

means for developing the image by supplying a developing member to the electrostatic image;

means for transferring the developed image from the image bearing body to a sheet;

means for heating the sheet, having the image transferred by the transferring means thereon, at a predetermined temperature;

means for selecting a mode between a usual mode and a preheat mode;

means for keeping the heating means at a first temperature in the usual mode, and for keeping the heating means at a second temperature which, is lower than the first temperature, in the preheat mode;

means, which is movable between a first position brought into contact with the heating means and a second position separated from the heating means, for pressing the image bearing member against the heating means at the first position;

means for moving the pressing means between the first position and the second position;

means for controlling the moving means to move the pressing means from the first position to the second position when the preheat mode is selected by the selecting means, and to move the pressing means from the second position to the first position when the usual mode is selected by the selecting means; and means for rotating the pressing means when the pressing means is located at the second position.

8. The apparatus according to claim 7, wherein the rotating means includes a first gear arranged in the heating means, a second gear arranged in the pressing means, a third gear meshed with the second gear when the pressing means is at the second position, a fourth gear meshed with the first gear and the third gear, and a motor for rotating the fourth gear.

9. The apparatus according to claim 8, wherein the second gear is movable in accordance with the movement of the pressing means.

10. The apparatus according to claim 7, wherein the second gear is engaged with the third gear when the pressing means is located at the second position, and the second gear is separated from the third gear when the pressing means is located at the first position.

* * * * *